US007461953B2

(12) United States Patent
Yamamoto

(10) Patent No.: US 7,461,953 B2
(45) Date of Patent: Dec. 9, 2008

(54) VEHICLE HEADLAMP

(75) Inventor: Ippei Yamamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/285,279

(22) Filed: Nov. 23, 2005

(65) Prior Publication Data

US 2006/0114687 A1 Jun. 1, 2006

(30) Foreign Application Priority Data

Nov. 26, 2004 (JP) ..... P. 2004-342743

(51) Int. Cl.
*F21V 7/00* (2006.01)
*F21V 21/16* (2006.01)
*H01K 1/14* (2006.01)

(52) U.S. Cl. ..... 362/296; 362/507; 313/315

(58) Field of Classification Search ..... 362/507, 362/516–519, 247, 296, 297; 313/315, 114–116, 313/318.11
See application file for complete search history.

(56) References Cited

U.S. PATENT DOCUMENTS 1,747,283 A * 2/1930 Bean ..... 362/235
1,923,181 A * 8/1933 Albers ..... 362/214
2,020,130 A * 11/1935 Astor ..... 313/111
4,225,903 A * 9/1980 Buchleitner ..... 362/518
4,227,113 A * 10/1980 Walsh ..... 313/112
4,268,895 A * 5/1981 Yabata ..... 362/519
4,305,119 A * 12/1981 Draper et al. ..... 362/518
4,523,262 A * 6/1985 Shinkai ..... 362/214
4,972,307 A * 11/1990 Takatsuji et al. ..... 362/309
5,192,962 A * 3/1993 Nishida et al. ..... 353/98
6,246,170 B1 * 6/2001 Sugawara ..... 313/570
6,644,828 B2 * 11/2003 Kinouchi ..... 362/214
2005/0083686 A1 * 4/2005 Yatsuda et al. ..... 362/230

FOREIGN PATENT DOCUMENTS

EP 0 884 522 A2 12/1998
JP 7-14404 A 1/1995

OTHER PUBLICATIONS

Office action from Chinese Patent Office dated Apr. 25, 2008, including English translation pp. 5-10.*

* cited by examiner

*Primary Examiner*—Hargobind S Sawhney
*Assistant Examiner*—David R. Crowe
(74) *Attorney, Agent, or Firm*—Sughrue Mion, PLLC

(57) ABSTRACT

A fog lamp is provided with a light source bulb having a filament as a light source for emitting light, and a secondary light source formed by reflection and collection of the light from the filament; and a reflector having a reflection surface that irradiates the light from the light source bulb forward. The reflection surface of the reflector is constructed so as to irradiate the light from the secondary light source downward of the predetermined cut-off line.

5 Claims, 10 Drawing Sheets

VEHICLE HEADLAMP

The present application claims foreign priority based on Japanese Patent Application No. P. 2004-342743, filed on Nov. 26, 2004, the contents of which are incorporated herein by reference.

BACKGROUND OF THE INVENTION

1. Field of the Invention

The present invention relates to a vehicle headlamp.

2. Related Art

To a vehicle such as an automobile, together with a headlamp forming high beam and low beam, a fog lamp can be attached as an auxiliary headlamp. The fog lamp is a lamp that does not illuminate a distant place several meters or more ahead like the headlamp forming high beam and low beam, but irradiates a comparatively wide range near the vehicle. Under a condition of poor visibility such as in a dense fog, the fog lamp improves visibility from another vehicle or a walker.

The fog lamp generally includes a light source bulb that emits light, a reflector that reflects the light from the light source bulb forward, and a cover lens that changes the traveling direction of the light from the reflector according to luminous distribution characteristic by refraction.

Further, disclosed in JP-A-07-014404 is an another type of a fog lamp, in which the reflection surface of the reflector is divided into plural parts, and the luminous distribution of the fog lamp is determined by only the reflector in place of the cover lens, whereby any optical characteristic is not given to the cover lens.

Usually, in the vehicle headlamp requiring attention to the luminous distribution characteristic such as the fog lamp, a light source bulb in which a secondary light source is not produced is used. The secondary light source means an imaginary light source formed as follows: the light emitted from the light source such as a filament in the light source bulb reflects on the inner surface and the outer surface of a glass tube of the light source bulb, and the reflection light is collected at a region in the light source bulb. In the secondary light source, a practical light emission matter does not exist. However, this becomes equal, by emission of the light collected on the secondary light source from the light source bulb, to the case where a light source exists in the position where the secondary light source exists.

Next, problems in case that the light source bulb in which such the secondary light source is formed is used will be described.

FIGS. 8A and 8B are diagrams showing images of the filament projected by the fog lamp, in which FIG. 8A shows a case where a light source bulb in which the secondary light source is not produced is used, and FIG. 8B shows a case where a light source bulb in which the secondary light source is produced is used.

Regarding the fog lamp, as shown in FIG. 8A, a position of a cut-off line is previously supposed, and a reflection surface of the reflector and cut of the cover lens are designed so that an end of the image of the filament is projected along this cut-off line. Thus, by projecting the end of the image of the filament along this cut-off line, a brightness-and-darkness boundary can be formed in FIG. 8A, which distinguishes between the brightness and the darkness at the upper and lower sides of the cut-off line.

However, in case that the light source bulb in which the secondary light source is produced is used, the light reflected by the upper half of the reflection surface of the reflector, as shown in FIG. 8B, leaks from an H-line to the upper portion though the cut-off line is supposed on the H-line and the reflection surface of the reflector and the cut of the cover lens are designed.

This is because in the light source bulb in which the secondary light source is produced, the length of the filament becomes practically long due to the secondary light source. Therefore, as shown in FIG. 9, in case that the reflection surface of the reflector and the cut of the cover lens are designed so that B-light from the rear end of the filament is irradiated along the cut-off line, C-light that has incident onto the upper portion of the reflection surface from the rear end of the secondary light source becomes larger than the B-light emitted from the rear end of the filament in incident angle on the reflection surface. In result, the C-light becomes larger also in reflection angle. Therefore, the C-light is irradiated more upward than the B-light emitted from the rear end of the filament.

Therefore, in case that the light source bulb in which the secondary light source is produced is used, the image of the secondary light source shown by a dashed line in FIG. 8B leaks above the supposed cut-off line, and the up-and-down boundary of the cut-off line becomes dim, so that clear brightness-and-darkness boundary cannot be formed.

Therefore, conventionally, the light source bulb in which the secondary light source is produced is not used in the vehicle headlamp such as the fog lamp.

SUMMARY OF THE INVENTION

One or more embodiments of the present invention provide a fog lamp that can form a clear cut-off line even in case that the light source bulb provided with the secondary light source is used, and a design method of the fog lamp.

In accordance with one or more embodiments of the present invention, a vehicle headlamp is provided with: a light source bulb; and a reflector provided with a reflection surface that irradiates the light from the light source bulb forward. In the vehicle headlamp, the light source bulb is provided with a light source that is arranged in a glass tube and emits light; and a secondary light source formed by reflection and collection of the light from the light source by the glass tube. In the vehicle headlamp, the reflection surface irradiates the light from the secondary light source downward of a predetermined cut-off line.

In addition, in accordance with one or more embodiments of the present invention, in the vehicle headlamp, the reflection surface may include: an upper area, wherein an end of an image of the secondary light source formed by the upper are a is projected on the predetermined cut-off line; a center area located below the upper area, wherein an end of an image of the light source formed by the center area is projected on the predetermined cut-off line; and a lower area located below the center area, wherein light reflected at the lower area is projected below the predetermined cut-off line.

Moreover, in accordance with one or more embodiments of the present invention, a vehicle headlamp is provided with: a light source bulb; and a reflector provided with a reflection surface that irradiates the light from the light source bulb forward. In the vehicle headlamp, the light source bulb includes: a glass tube having the spherical shape; and a light source arranged in the glass tube at a front side of a center of the glass tube. In the vehicle headlamp, the reflection surface irradiates the light from the light source bulb downward of a predetermined cut-off line.

According to one or more embodiments of the invention, the reflection surface of the reflector is designed and formed so that the light from the secondary light source is irradiated downward of the predetermined cut-off line. Therefore, the light emitted from the secondary light source does not leak upward of the cut-off line, so that the cut-off line that becomes a clear brightness-and-darkness boundary can be formed.

Further, according to one or more embodiments of the invention, in the vehicle headlamp having the light source bulb including the glass tube having the spherical shape, and the light source arranged in the glass tube, in case that the light source is attached to the front side of a center of the glass tube, the reflection surface is so constructed as to irradiate the light from the light source bulb downward of the predetermined cut-off line. Thus, even if the secondary light source is produced in the light source bulb, the reflection surface is so constructed as to irradiate the light from the light source bulb including the light from the secondary light source downward of the predetermined cut-off line. Therefore, the light does not leak from the cut-off line upward, and the cut-off line does not become unclear. Accordingly, even if the secondary light source is produced, it is possible to provide the vehicle headlamp which can form the cut-off line that becomes the clear brightness-and-darkness boundary.

Specifically, in the area where an image of the secondary light source is projected above an image of the filament, the reflection surface is formed so that the light emitted from the rear end of the secondary light source is irradiated on and along the cut-off line, that is, so that the cut-off line is formed by the light that is emitted from the rear end of the secondary light source, reflected on the reflection surface, and irradiated forward. By such the construction, the clear cut-off line can be formed in the intended position.

Further, in case that the secondary light source is formed in front of the filament, the image of the secondary light source is not projected above the image of the filament. Accordingly, in this case, the cut-off line is formed by the end of the image of the filament, whereby the clear cut-off line can be formed in the intended position.

Further, in one or more embodiments of the invention, the reflection surface is composed of plural reflection surfaces divided in the horizontal direction. Therefore, without using a cover lens, a luminous distribution pattern can be determined by only the reflection surface.

Further, since a reflection surface for over head line (OHS) light is formed at the upper portion of the reflection surface, the OHS area satisfying laws and regulations can be appropriately formed.

Other aspects and advantages of the invention will be apparent from the following description and the appended claims.

DESCRIPTION OF THE PREFERRED EMBODIMENTS

Embodiments of the invention will be described with reference to the accompanying drawings.

Figure 1:
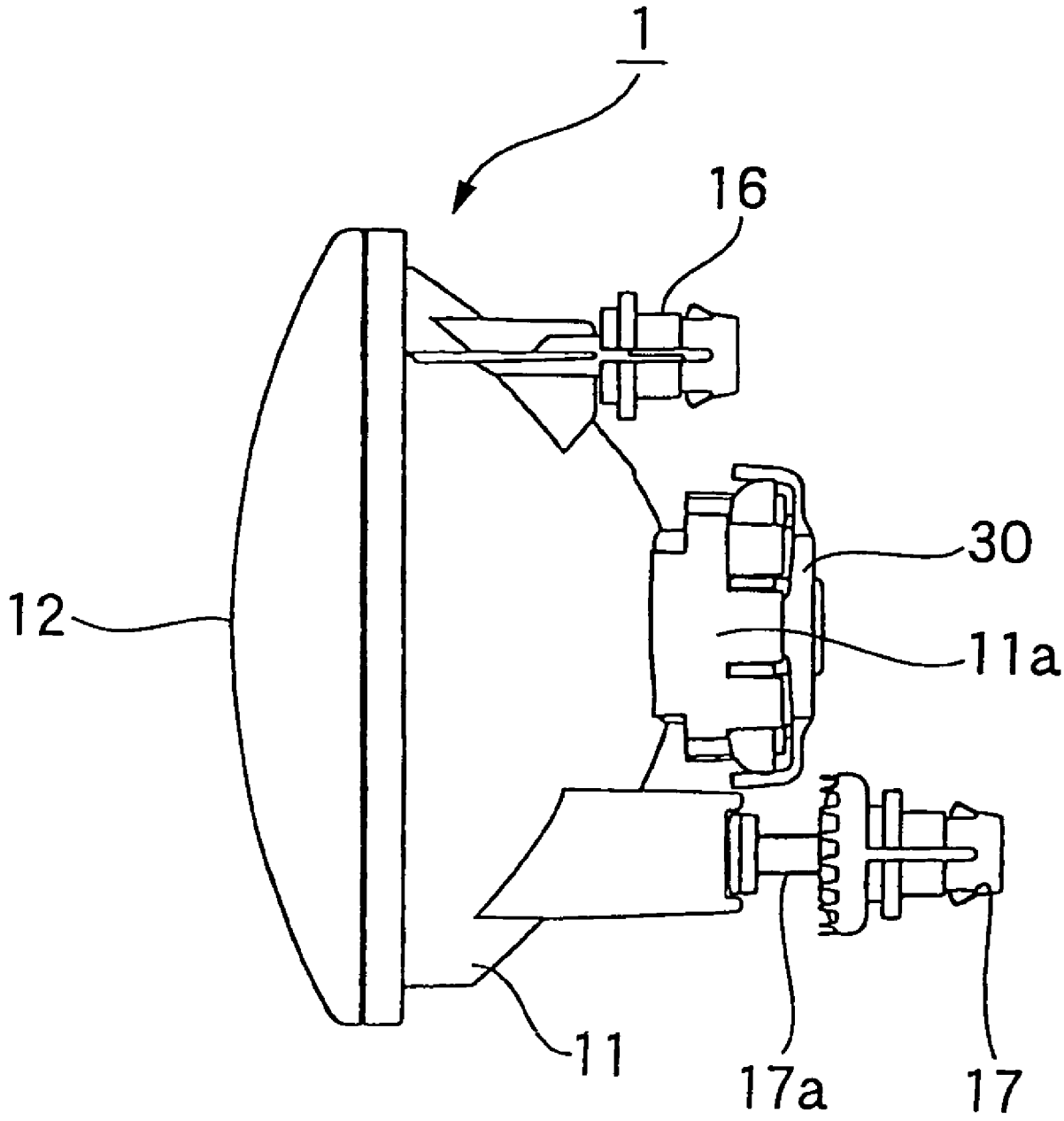
FIG. 1 is a side view of a fog lamp as one embodiment of a vehicle headlamp according to the invention.
Figure 2:
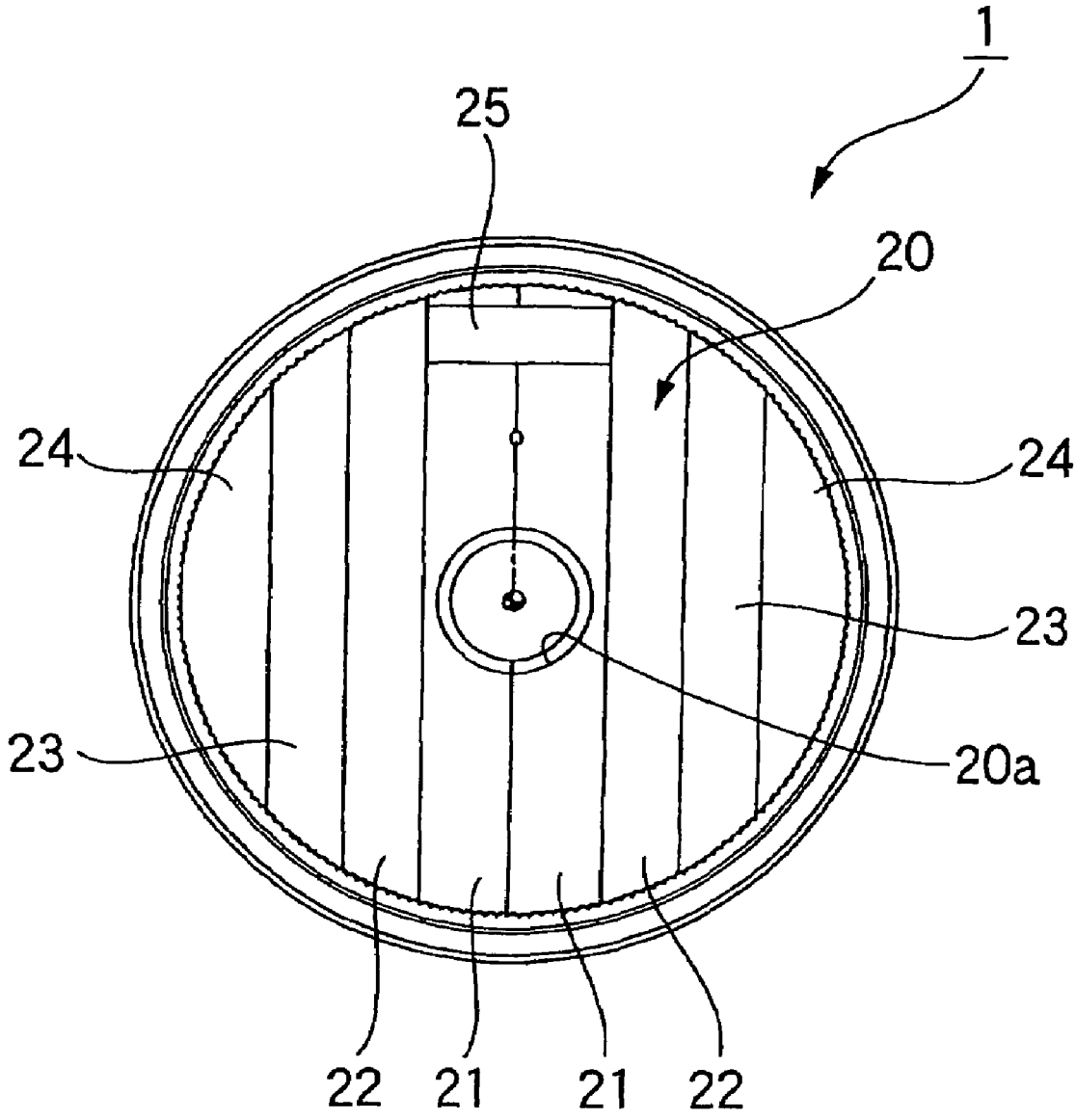
FIG. 2 is a front view of the fog lamp.
Figure 3:
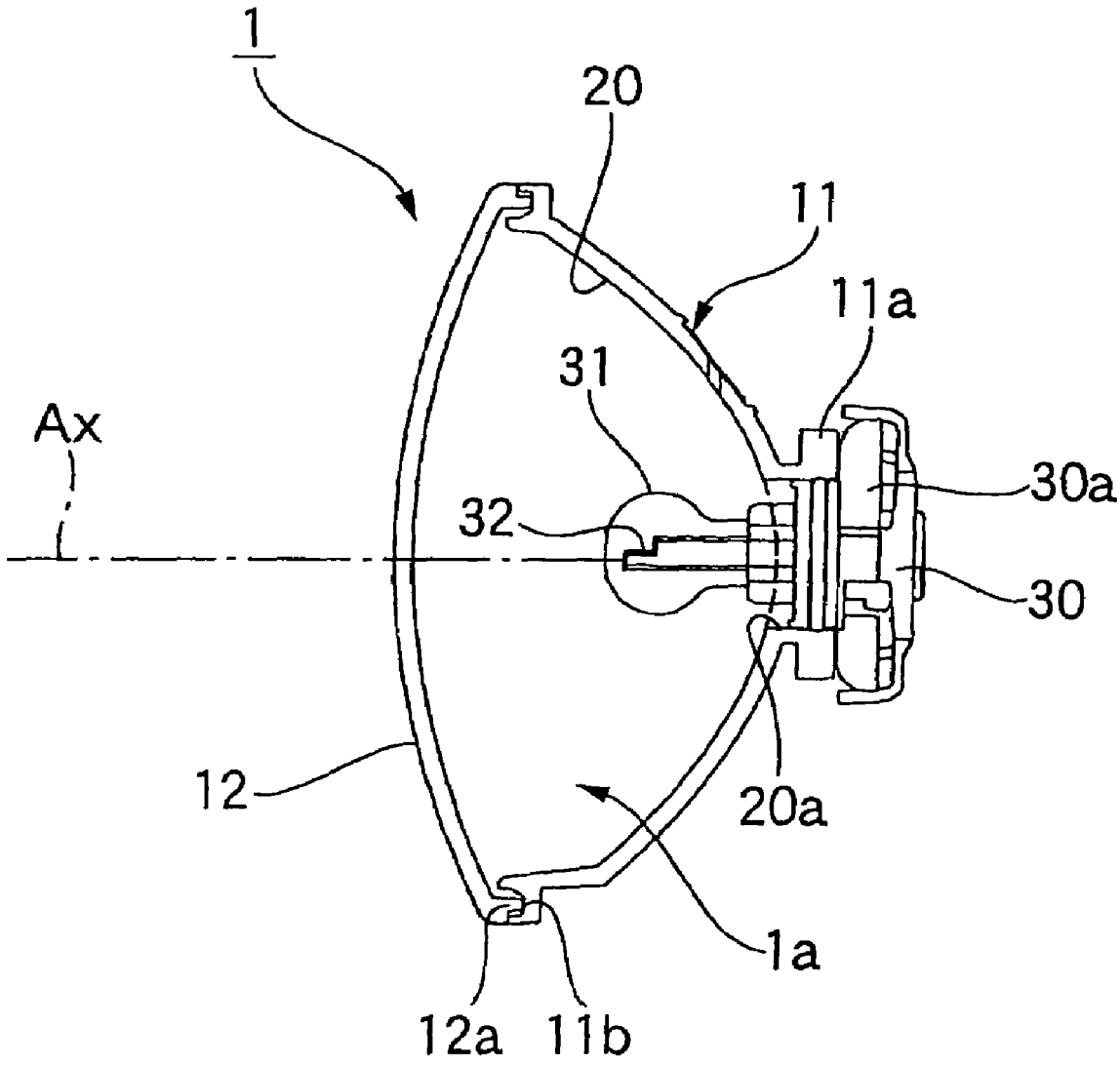
FIG. 3 is a sectional view of the fog lamp.
Figure 4A:
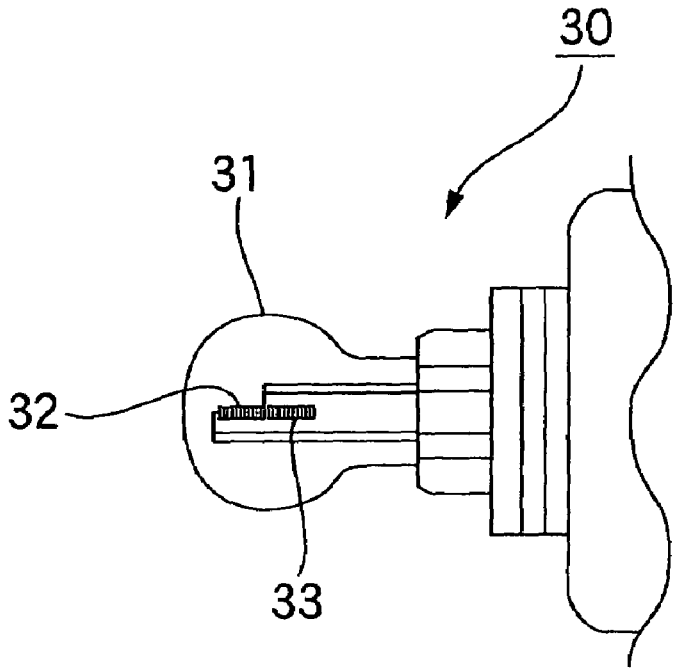
FIG. 4A is an enlarged view of a light source bulb.
Figure 4B:
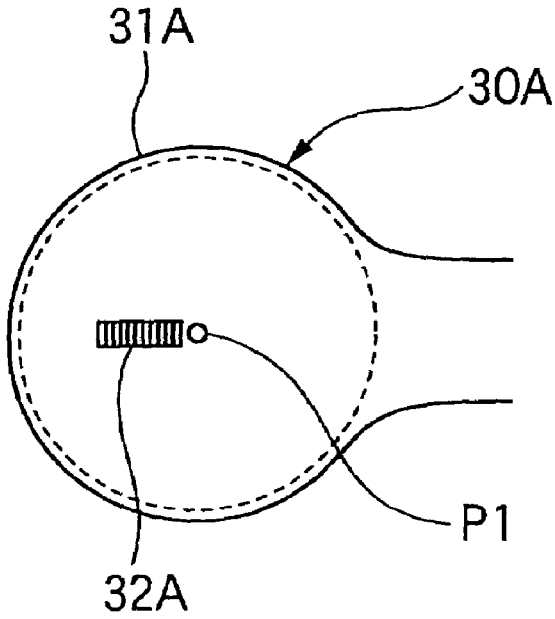
FIG. 4B shows a light source bulb in which a secondary light source is produced.
Figure 4C:
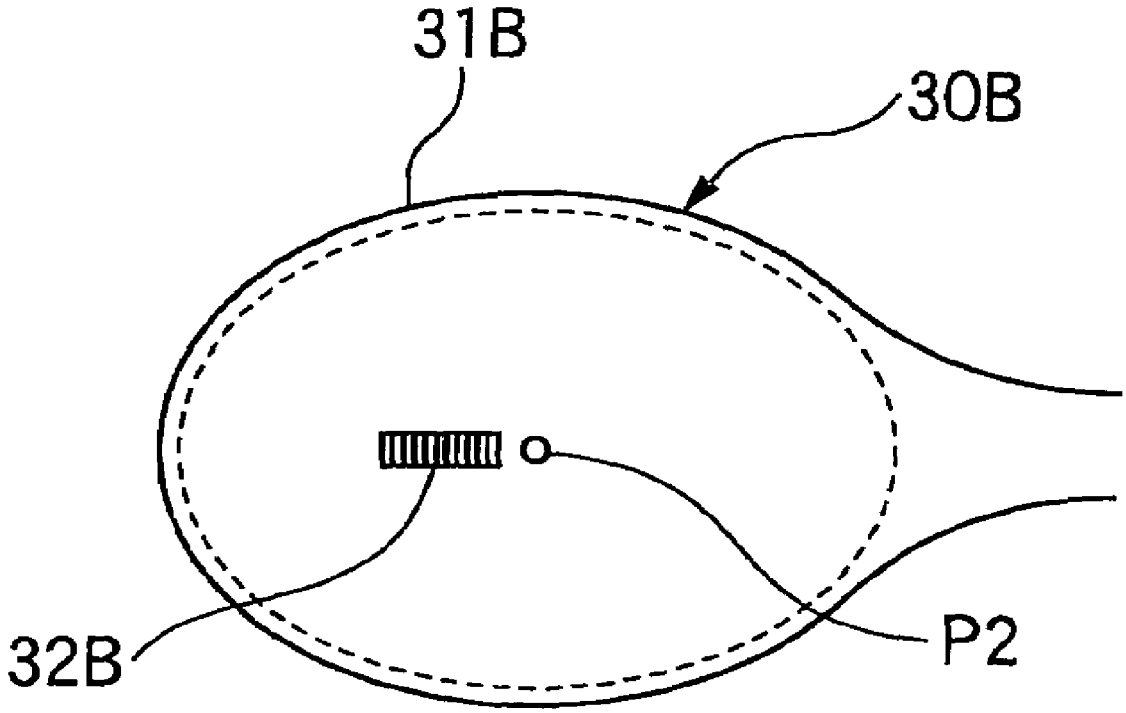
FIG. 4C shows a light source bulb in which a secondary light source is produced.

FIG. 1 is a side view of a fog lamp as one embodiment of the vehicle headlamp according to the invention. FIG. 2 is a front view of the fog lamp. FIG. 3 is a sectional view of the fog lamp. FIGS. 4A to 4C are enlarged views of a light source bulb, in which FIG. 4A shows the light source bulb in this embodiment, and FIGS. 4B and 4C show examples of a light source bulb in which a secondary light source is produced.

A fog lamp 1 in the embodiment is a vehicle auxiliary headlamp that irradiates the comparatively wide area near a vehicle. The fog lamp 1 is turned on under a condition of poor visibility such as in a dense fog, thereby to improve visibility from another vehicle or a walker.

The fog lamp 1, as shown in FIGS. 1 to 4C, includes mainly a reflector 11, a transparent cover 12 attached so as to cover the front surface of the reflector 11, and a light source bulb 30 in which a filament 32 is arranged as a light source in an inner space 1*a* between the reflector 11 and the transparent cover 12.

The reflector 11 is a base body having an early paraboloidal reflection surface 20 on its inner surface side, and the reflector 11 is attached to the vehicle through an aiming fulcrum member 16 and an aiming acting member 17 that are attached on the rear surface side of the reflector 11. The aiming acting member 17 is mainly composed of an aiming screw 17*a* attached to the reflector 11 rotatably. The aiming screw 17*a* rotates through a not-shown adjusting member, whereby the whole of the reflector 11 tilts with the aiming fulcrum member 16 as a fulcrum, and the direction of an optical axis Ax of the fog lamp 1 is adjusted.

At the peripheral edge on the front side of the reflector 11, a fitting groove 11*b* is formed along the peripheral edge. Into this fitting groove 11*b*, a fitting convex part 12*a* of the transparent cover 12 is fitted and joined by adhesive, ultrasonic welding, or the like. The transparent cover 12 is a light transmissible cover that has no optical characteristic, transmits the light from the inner space 1*a* of the fog lamp 1 intactly, and irradiates the light forward.

The reflection surface 20 of the reflector 11, as shown in FIG. 2, is divided in the horizontal direction into eight reflection areas 21 to 24 by plural division lines in the longitudinal direction, that is, in the vertical direction, and at each reflection area 21 to 24, a reflection surface according to luminous distribution characteristic of the fog lamp is formed. Further, above a through-hole 20*a* of the reflection surface 20, an OHS reflection area 25 that forms light for OHS is formed. In FIG. 3, the reflection area represented by the same reference numeral is the same reflection surface on function. The characteristics of each reflection area will be described later.

Further, in the reflector 11, a through-hole 20*a* is formed, which has a center axis of the reflection surface 20 as a center, and is circular in section. Into this through-hole 20*a*, the light source bulb 30 is inserted from the rear surface side of the reflector 11, and the light source bulb 30 is attached and fixed to a light source bulb attaching part 11*a* provided near the through-hole 20*a* of the reflector 11 and on the rear surface side of the reflector 11.

The light source bulb 30 includes a hollow glass tube 31 on the front side of a bulb base body 30*a*, and a filament (light source) 32 arranged in the glass tube 31. The light emitted from the light source bulb 30 is reflected on the reflection surface 20 of the reflector 11 forward, and irradiated forward through the transparent cover 12.

The light source 30 in the embodiment is a bulb in which a secondary light source 33 is produced. The secondary light source 33 is an imaginary light source formed as follows: the light emitted from the filament 32 reflects on the inner surface and the outer surface of the glass tube 31, and the reflection light is collected and imaged at a region in the light source bulb 30. In the secondary light source 33, a practical light emission matter does not exist. However, this becomes equal, by emission of the light collected on the secondary light source 33 from the light source bulb 30, to the case where the practical light source exists in the position where the secondary light source 33 exists.

In the light source bulb 30 in the embodiment, the secondary light source 33, as shown in FIG. 4A, is formed on the rear side of the filament 32. Thus, as the light source bulb 30 in which the secondary light source 33 is formed on the rear side of the filament 32, it is a condition that the glass tube 31 has the spherical shape such as a sphere or an ellipse, and the light source body such as the filament 32 is located on the front side of the center of the glass tube 31 shape. In the light source bulb 30 shown in FIG. 4A, the filament 32 is arranged on the front side of a center P of the nearly spherical glass tube 30.

Further, as shown in FIG. 4B, in a light source bulb 30A having a nearly spherical glass tube 31A, in case that the shape of the glass tube 31 approximates to a sphere (corresponding to the shape shown by a dashed line in FIG. 4B), and a light source body 32A such as a filament exists on the front side of a center P1 of its sphere, a secondary light source is produced on the backside of the P1.

Similarly, as shown in FIG. 4C, in a light source bulb 30B having a nearly ellipsoidal glass tube 31B, in case that the shape of the glass tube 31 approximates to an ellipse (corresponding to the shape shown by a dashed line in FIG. 4C), and a light source body 32B such as a filament exists on the front side of a center P2 of its ellipse, a secondary light source is produced on the backside of the P2.

Figure 8A:
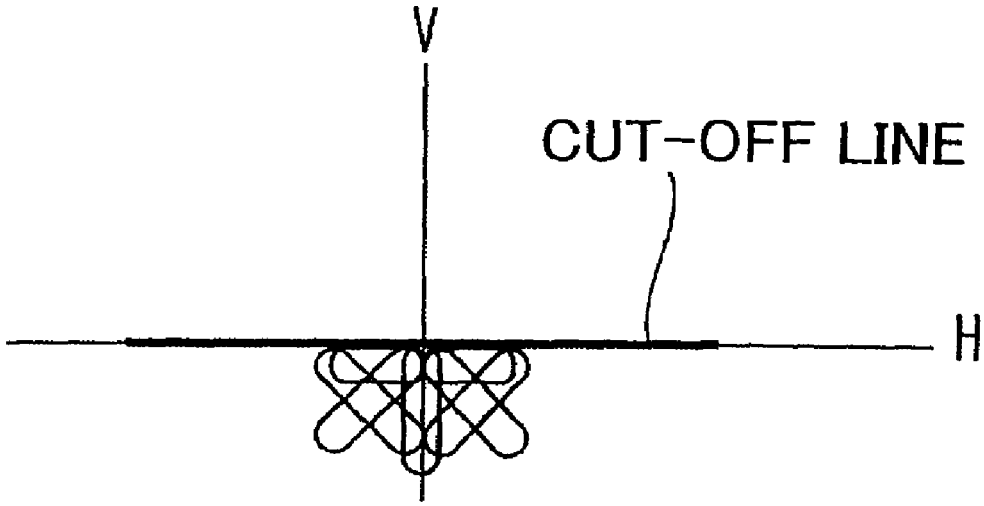
FIGS. 8A-8B are diagrams for explaining the conventional problem.
Figure 8B:
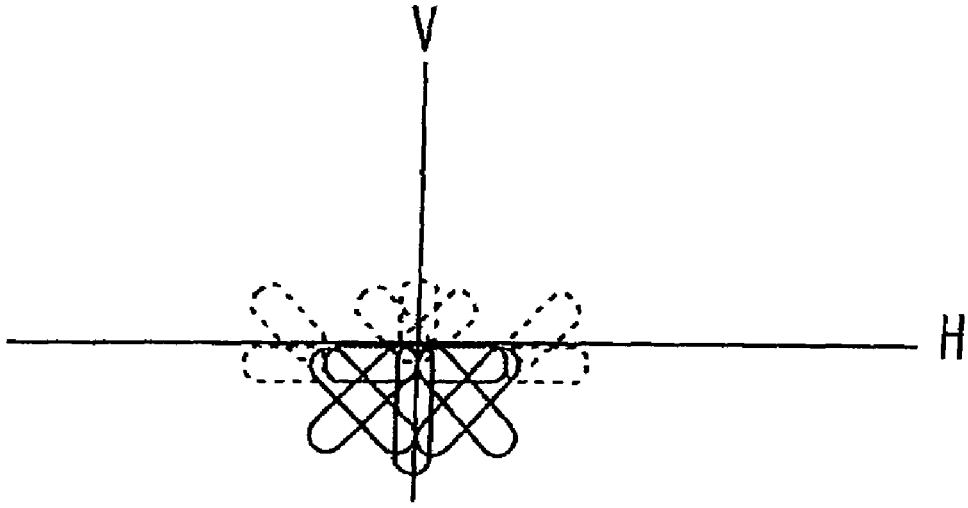
Figure 9:
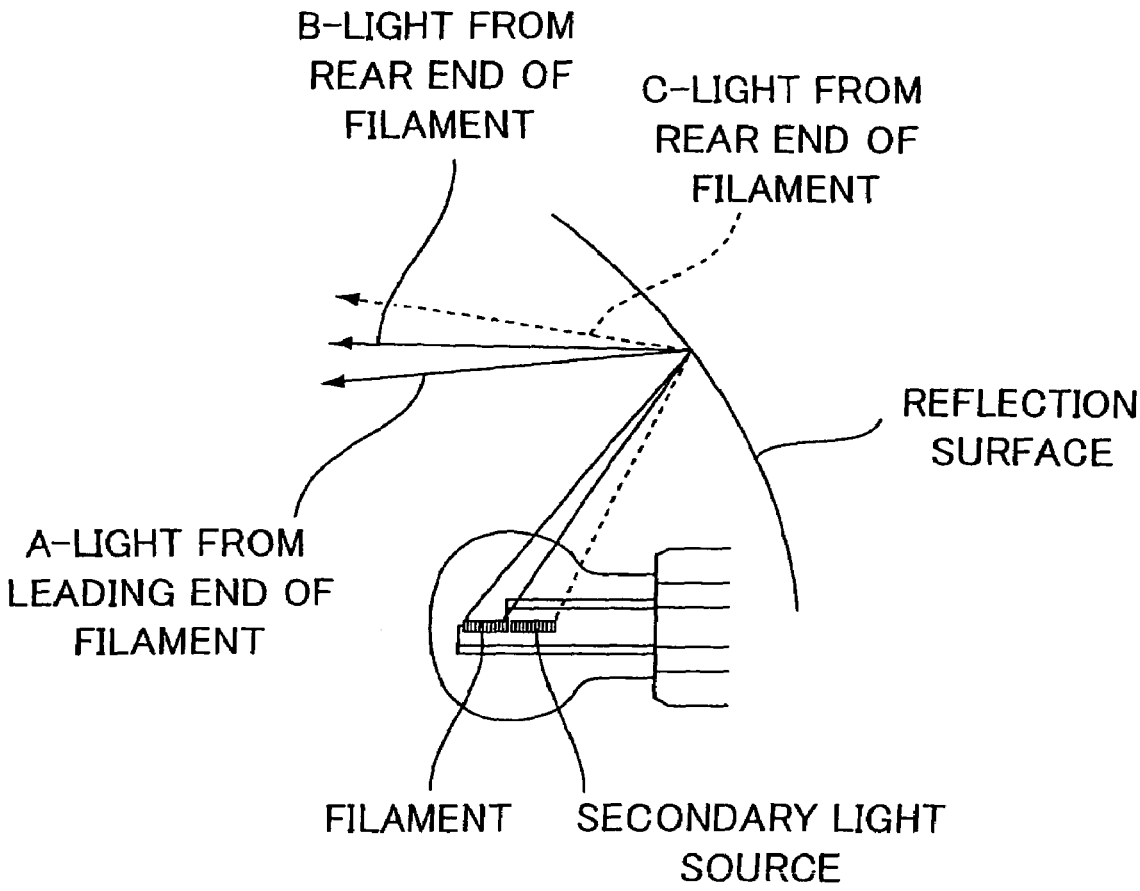
FIG. 9 is a diagram for explaining the conventional problem.

In case that the reflection surface 20 is designed using such the light source bulb 30 having the secondary light source 33 like the conventional reflection surface, the light that has reflected on the upper portion side of the reflection surface 20, as shown in FIG. 8B, leaks upward of a cut-off line, so that the cut-off line becomes unclear. Therefore, in the embodiment, the reflection surface 20 is not formed so that one end of an image of the filament 32 is irradiated along the cut-off line, but is formed, thinking the filament 32 and the secondary light source 33 as one light source, so that the end of the filament 32 or the end of the secondary light source 33 is irradiated along the cut-off line. Hereby, the reflection surface 20 is designed so that the light from the secondary light source 33 is irradiated downward of the cut-off line.

Figure 5:
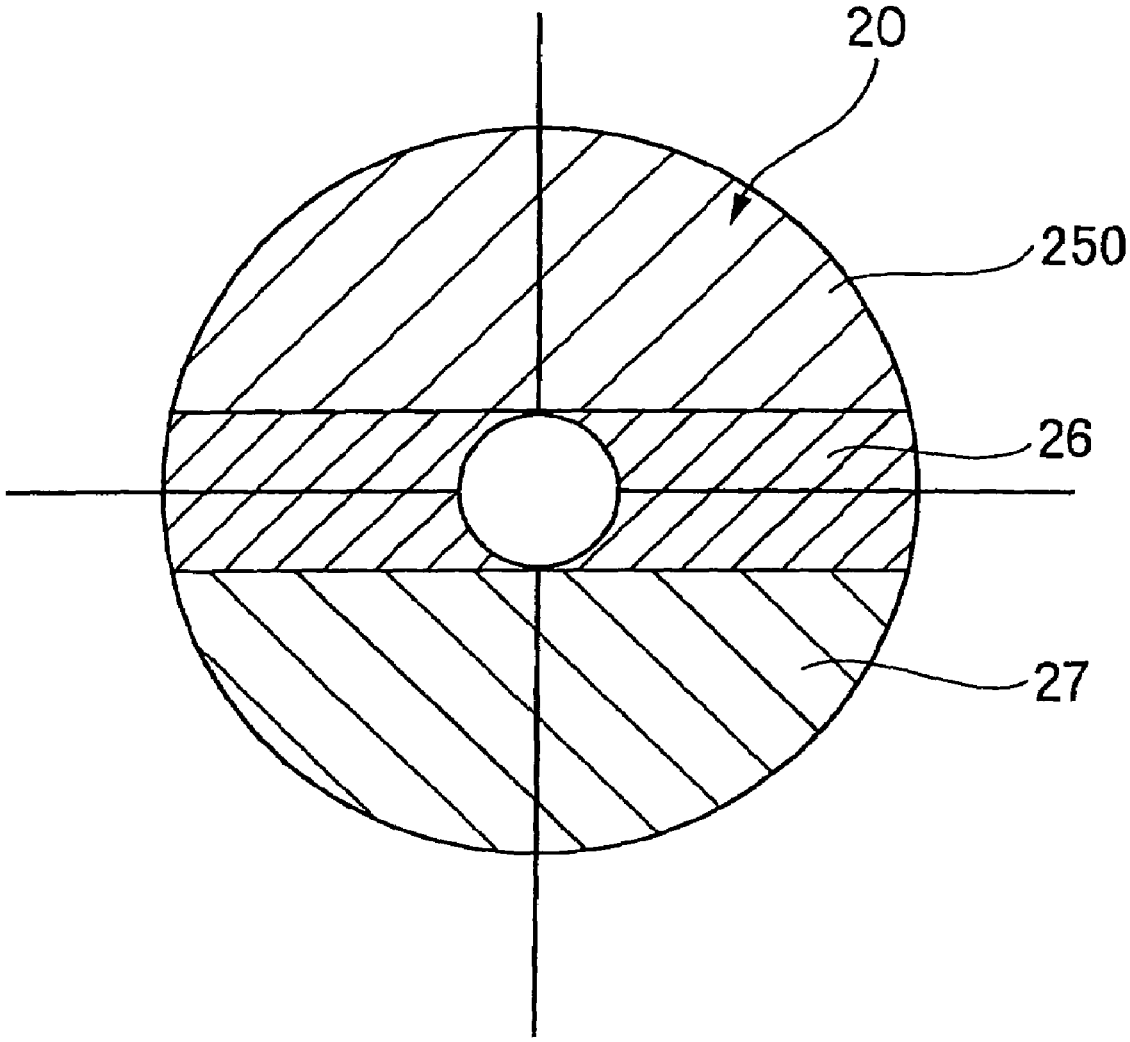
FIG. 5 is a diagram showing longitudinal area division in design and formation of a reflection surface.
Figure 6A:
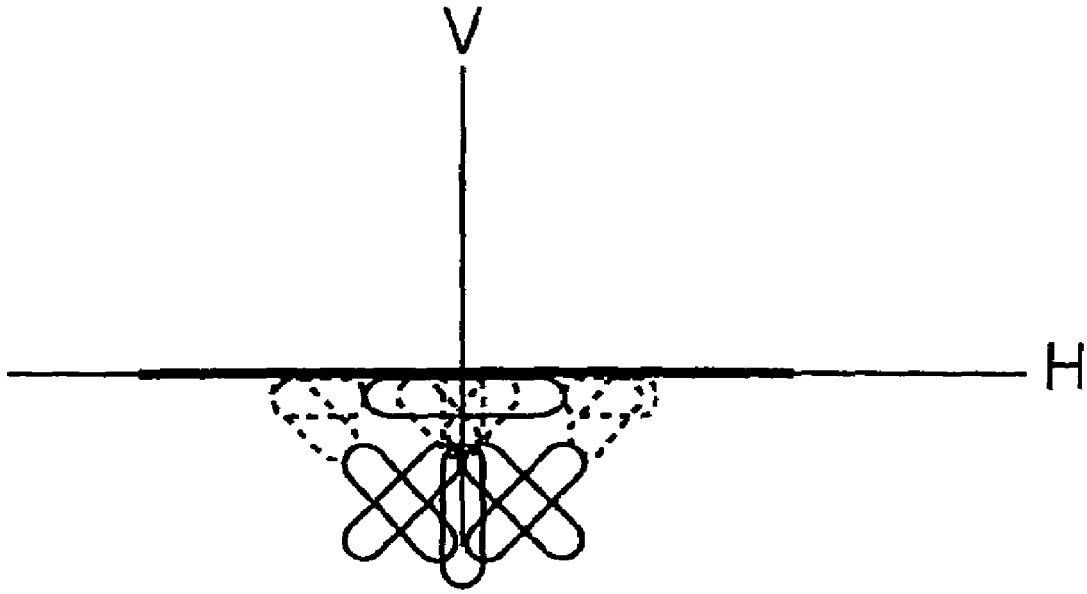
FIG. 6A is a schematic diagram showing a relation between a filament image, a secondary light source image, and a cut-off line, in which the filament image and the secondary light source image are formed by the upper area of the reflection surface.
Figure 6B:
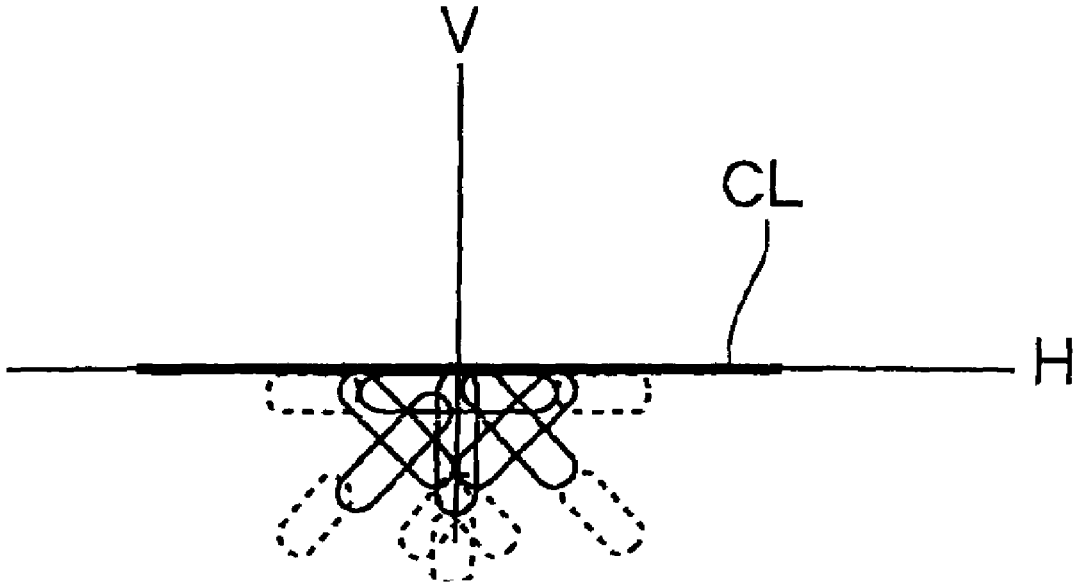
FIG. 6B is a schematic diagram showing a relation between a filament image, a secondary light source image, and a cut-off line, in which an upper end of the filament image is on the cut-off line.

Specifically, in the embodiment, as shown in FIG. 5, firstly, it is thought that the reflection surface 20 is divided in the vertical direction into three areas. In an upper area 250, an image of the secondary light source 33 is projected above an image of the filament 32. In the upper area 250, in case that the reflection surface 20 is designed so that the end (specifically, rear end) of the filament 32 is projected on the cut-off line, the image of the secondary light source 33 is projected upward of the cut-off line. Therefore, in this area 250, as shown in FIG. 6A, the reflection surface is formed so that the upper end of the image of the secondary light source 33 is projected on the cut-off line CL. In FIGS. 6A and 6B, a solid line represents the image of the filament 32, and a dashed line represents the image of the secondary light source 33.

In a center area 26 located below the upper area 250, the image of the filament 32 nearly coincides with the image formed by the secondary light source 33. In this area, similarly to the conventional case, the reflection surface is formed so that the end of the filament 32 is projected on the cut-off line CL.

Further, in a lower area 27 located below the center area 26, the image of the secondary light source 33 is projected below the image of the filament 32. The reflection surface is formed so that the light that has reflected at this lower area 27 is projected below the cut-off line CL.

Thus, in the embodiment, in the area where the image of the secondary light source is projected above the image of the filament 32, the reflection surface 20 is formed so that the light emitted from the rear end of the secondary light source 33 is irradiated or and along the cut-off line, that is, so that the cut-off line is formed by the light emitted from the rear end of the secondary light source 33, reflected on the reflection surface 20 and irradiated forward. By such the construction, a clear cut-off line can be formed between the end of the secondary light source and its upper area.

In the above description, in the light source bulb 30, the secondary light source 33 is formed at the back of the filament 32. However, in case that the secondary light source 33 is formed in front of the filament, the image of the secondary light source 33 that forms the cut-off line is not projected above the image of the filament 32 by the upper area 250. Therefore, as shown in FIG. 6B, it is proper that the cut-off line is formed by the end of the image of the filament.

Next, roles of the reflection areas 21 to 24 and the OHS reflection area 25 of the reflection surface 20 shown in FIG. 2 will be described.

Figure 7A:
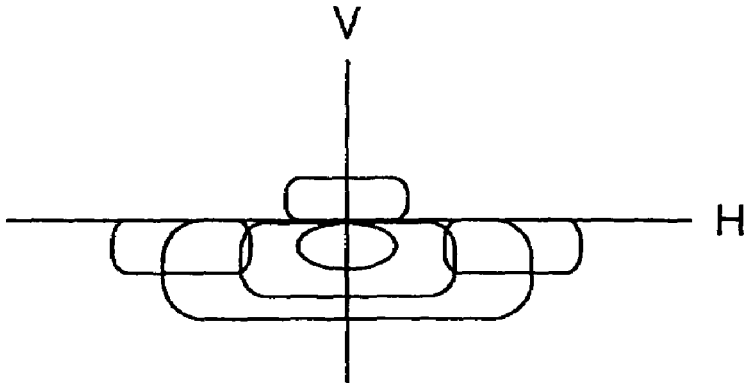
FIG. 7A shows a whole image of luminous distribution patterns formed by all the reflection areas.
Figure 7B:
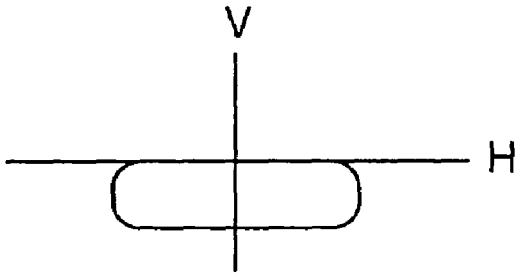
FIG. 7B shows a luminous distribution pattern formed by the reflection area 21.
Figure 7C:
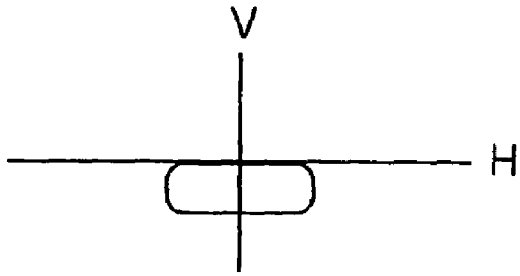
FIG. 7C shows a luminous distribution pattern formed by the reflection area 22.
Figure 7D:
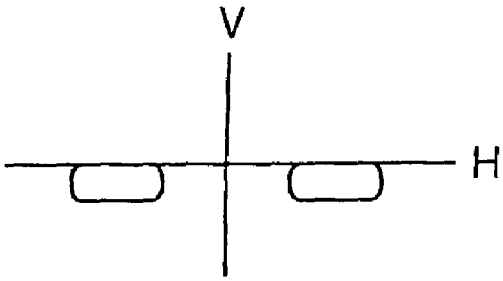
FIG. 7D shows a luminous distribution pattern formed by the reflection area 23.
Figure 7E:
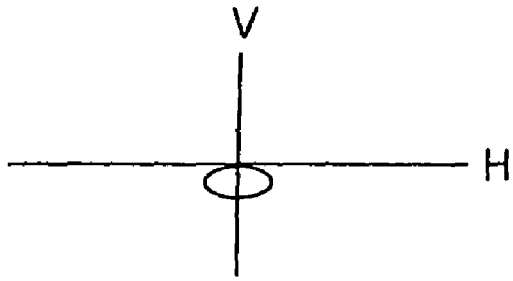
FIG. 7E shows a luminous distribution pattern formed by the reflection area 24.

FIGS. 7A to 7E show luminous distribution patterns formed by each reflection area 21 to 24 and the OHS reflection area 25 of the reflection surface 20. Herein, FIG. 7A shows a whole image of the luminous distribution patterns formed by all the reflection areas 21 to 25, FIG. 7B shows a luminous distribution pattern formed by the reflection area 21, FIG. 7C shows a luminous distribution pattern formed by the reflection area 22, FIG. 7D shows a luminous distribution pattern formed by the reflection area 23, and FIG. 7E shows a luminous distribution pattern formed by the reflection area 24.

Firstly, the reflection area 21 is a reflection surface that forms a luminous distribution pattern that extends over the length and breadth near the cut-off line. In the reflection area 21, particularly, the diffuse ratio of the upper portion of the reflection area 21 is made high, so that a spread of the luminous distribution pattern is formed.

The reflection area 22 is a reflection surface that forms a luminous distribution pattern near the cut-off line similarly to the reflection area 21, though this luminous distribution pattern is not wider than the luminous distribution pattern of the reflection area 21. By superimposing the luminous distribution pattern formed by the reflection area 22 on the luminous distribution pattern formed by the reflection area 21, the light quantity near the center is increased.

The reflection area 23 is a reflection surface that forms a luminous distribution pattern which projects light to the right end portion and the left end portion near the cut-off line. This reflection area 23 gives a more lateral spread to the luminous distribution pattern formed by the reflection area 21.

The reflection area 24 is a reflection surface that forms a luminous distribution pattern that is collected at a hot zone of a luminous distribution pattern center portion near the cut-off line. By heightening the intensity of the light at the hot zone, the light reaches farther, so that visibility of a distant place improves, and visibility from a car running on the opposite lane also improves.

The OHS reflection area 25 is a reflection surface that forms a luminous distribution pattern that projects light forming the OHS area in the center of the H-line upper portion.

In the fog lamp 1 in the embodiment, by these reflection areas 21 to 25, a fog lamp luminous distribution pattern as shown in FIG. 7A is formed, which has a large quantity of light in the center area, and a spread also in the width direction. Each reflection area 21 to 25, according to the vertical positions shown in FIG. 5, has the reflection surface that forms the cut-off line at the end of the filament 32 or the end of the secondary light source 33. Therefore, the cut-off line can be clearly formed.

As described above, the fog lamp 1 as the vehicle headlamp in the embodiment includes the light source bulb 30 having the filament 32 that is a light source for emitting light, and the secondary light source 33 formed by reflection and collection of the light from the filament 32; the reflector 11 having the reflection surface 20 that irradiates the light from the light source bulb 30 forward; and the transparent cover 12 that is a cover member attached in the front of the reflector 11. The reflection surface 20 of the reflector 11 is constructed so as to irradiate the light from the secondary light source 33 downward of the predetermined cut-off line.

Therefore, according to the embodiment, the light emitted from the secondary light source does not leak above the cut-off line, and the cut-off line that becomes the clear brightness-and-darkness boundary can be formed.

Further, the reflection surface 20 of the fog lamp 1 in the embodiment is so designed as to be divided in the longitudinal direction into the three areas 250, 26, 27. The upper area 250 forms the cut-off line by the end of the secondary light source 33.

Thus, in the embodiment, in the area where the image of the secondary light source 33 is projected above the image of the filament 32, the reflection surface 20 is formed so that the light emitted from the rear end of the secondary light source 33 is irradiated on and along the cut-off line, that is, so that the cut-off line is formed by the light that is emitted from the rear end of the secondary light source, reflected on the reflection surface 20, and irradiated forward. By such the construction, the clear cut-off line can be formed in the intended position.

Further, in the embodiment, the case in which the secondary light source 33 is formed at the back of the filament 32 has been described. However, in case that the secondary light source 33 is formed in front of the filament 32, the image of the secondary light source is not projected above the image of the filament 32. Accordingly, in this case, the cut-off line is formed by the end of the image of the filament 32, whereby the clear cut-off line can be formed in the intended position.

Further, in the embodiment, the reflection surface 20 is composed of the plural reflection surfaces 21 to 24 divided in the horizontal direction. Therefore, without using the cover lens, the luminous distribution pattern can be determined by only the reflection surface 20.

Further, at the upper portion of the reflection surface 20, the reflection surface 25 for OHS light is formed. Therefore, the OHS area satisfying laws and regulations can be appropriately formed.

In the embodiment, the fog lamp is taken as an example. However, the invention is not limited to this, but various auxiliary headlamps having the similar structure can be used.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle headlamp comprising:

a light source bulb; and a reflector provided with a reflection surface that irradiates the light from the light source bulb forward, wherein the light source bulb includes:

an actual light source that is arranged in a glass tube at a front of a center of the glass tube and emits light, no actual light source being arranged in the glass tube at a rear of the center of the glass tube, wherein the glass tube has a spherical shape; and a virtual, secondary light source formed at a rear of the center of the glass tube by reflection and collection of the light from the actual light source by the glass tube, the glass tube being configured to provide the secondary light source, and the reflection surface is configured to irradiate the light from the virtual, secondary light source downward of a predetermined cut-off line;

the predetermined cut-off line is formed as an upper extent of an image of the actual light source reflected by the reflection surface;

the reflection surface includes an upper area provided above the light source bulb, the upper area configured such that an entire image of the virtual, secondary light source reflected by the upper area is projected at or below the predetermined cut-off line, and an upper extent of the image of the virtual, secondary light source is irradiated along the predetermined cut-off line.

2. The vehicle headlamp according to claim 1, wherein the reflection surface further includes:

a center area located below the upper area, configured such that an end of an image of the actual light source formed by the center area is projected on the predetermined cut-off line; and a lower area located below the center area, configured such that light reflected at the lower area is projected below the predetermined cut-off line.

3. The vehicle headlamp according to claim 1, wherein the vehicle headlamp is provided as a fog lamp.

4. A vehicle headlamp comprising:

a light source bulb; and a reflector provided with a reflection surface that irradiates the light from the light source bulb forward, wherein the light source bulb includes:

a glass tube having the spherical shape;

an actual light source arranged in the glass tube at a front side of a center of the glass tube, no actual light source being arranged in the glass tube at a rear of the center of the glass tube, and a virtual, secondary light source formed at a rear of the center of the glass tube by reflection and collection of the light from the actual light source by the glass tube, the glass tube being configured to provide the virtual, secondary light source, the reflection surface is configured to irradiate the light from the actual light source that is not reflected by the glass tube and the light from the virtual, secondary light source downward of a predetermined cut-off line;

the predetermined cut-off line is formed as an upper extent of an image of the actual light source reflected by the reflection surface, the reflection surface includes an upper area provided above the light source bulb, the upper area configured such that an entire image of the virtual, secondary light source reflected by the upper area is projected at or below the predetermined cut-off line; and an upper extent of the image of the virtual, secondary light source is irradiated along the predetermined cut-off line.

5. The vehicle headlamp according to claim 4, wherein the vehicle headlamp is provided as a fog lamp.

* * * * *